US005483224A

United States Patent [19]

Rankin et al.

[11] Patent Number: 5,483,224

[45] Date of Patent: Jan. 9, 1996

[54] SECURITY SYSTEM AND METHOD FOR MONITORING SECURITY IN THE VICINITY OF A LOCATION PERIMETER

[75] Inventors: Kathleen V. Rankin, Greensboro; Kurt W. Niederer, Charlotte, both of N.C.

[73] Assignee: Kitty Rankin, Inc., Greensboro, N.C.

[21] Appl. No.: 310,573

[22] Filed: Sep. 22, 1994

[51] Int. Cl.[6] ..... G08B 1/08

[52] U.S. Cl. ..... 340/539; 340/541; 340/545; 340/546; 340/531; 340/521; 340/584

[58] Field of Search ..... 340/545, 546, 340/531, 521, 584, 539

[56] References Cited

U.S. PATENT DOCUMENTS

| | | | |
|---|---|---|---|
| 3,445,848 | 5/1969 | Goldstein . | |
| 3,614,760 | 10/1971 | Zimmet . | |
| 4,148,019 | 4/1979 | Durkee | 340/545 |
| 4,200,862 | 4/1980 | Campbell . | |
| 4,218,681 | 8/1980 | Hormann . | |
| 4,464,651 | 8/1984 | Duhame . | |
| 4,686,380 | 8/1987 | Angott . | |
| 4,808,995 | 2/1989 | Clark . | |
| 4,866,434 | 9/1989 | Keeman . | |
| 4,988,992 | 1/1991 | Heitschel . | |
| 5,235,328 | 8/1993 | Kurita . | |

*Primary Examiner*—John K. Peng
*Assistant Examiner*—Albert K. Wong
*Attorney, Agent, or Firm*—W. Thad Adams, III

[57] ABSTRACT

A security system and method for monitoring security in the vicinity of a location perimeter is provided. The security system includes security sensors positioned in a detecting relation to the location perimeter for detecting a condition indicating a potential violation of security in the vicinity of the perimeter. The security sensors have a normal, negative state indicative of no violation of security and a positive state indicative of a potential violation of security. A detection indicator operatively communicates with the security sensors for storing information indicating whether a security sensor is in the positive or negative state. A signal receiver operatively communicates with the detection indicator. A signal transmitter is activated from outside the location perimeter, and transmits a control signal to the signal receiver. A warning device operatively communicates with the detection indicator for indicating to a position outside the location perimeter the current positive or negative state of the security sensor.

19 Claims, 7 Drawing Sheets

SECURITY SYSTEM AND METHOD FOR MONITORING SECURITY IN THE VICINITY OF A LOCATION PERIMETER

TECHNICAL FIELD AND BACKGROUND OF THE INVENTION

This invention relates to a security system and method for monitoring security in the vicinity of a location perimeter. The invention is applicable to a residence for providing a warning signal to the resident indicating whether an intruder has been detected over a given time period. The warning signal is readily perceived by the resident from a distance, so that the resident is not required to leave the relative safety of an automobile or friends before encountering a potentially dangerous condition. If no intruder has been detected, the invention automatically triggers operation of one or more preselected electrical accessories associated with the home. The accessories may be an automatic door opener, floodlights, kitchen appliances, garage doors, interior lights, outdoor lights, and the like.

The invention addresses the problem of home security, and the increasing concern for personal safety of those living in both urban and rural areas. An individual is especially susceptible to attack by an intruder from the time he or she leaves an automobile, or a group of friends, up to the time he or she enters the home and re-locks the door. Several factors add to the vulnerability of the resident. For example, the intruder generally cannot be seen by the resident or neighbors prior to attacking. The resident often has arms filled with grocery bags, a handbag, a brief case, or the like, prior to entering the home, and cannot easily escape or defend against the intruder. In addition, the intruder may hide in nearby trees or shrubbery, and wait until after the resident has unlocked the door before staging his attack and entering the home.

Some alarms of the prior art, when triggered, emit a relatively loud sound or bright light intended to frighten the intruder, but turn off after a relatively short time. Other alarms are triggered only in response to some physical contact with the exterior or interior of the home. The such devices are generally inadequate for warning the resident, and deterring an intruder and potential attack prior to entering the home.

SUMMARY OF THE INVENTION

Therefore, it is an object of the invention to provide a security system which includes a warning device perceived from an area outside of the residence for indicating to the resident whether a potentially dangerous condition exists in or surrounding the home.

It is another object of the invention to provide a security system which stores information for subsequent determination by the system indicating whether a potential breach of security exists within the vicinity of the home.

It is another object of the invention to provide a security system which includes a hand-held remote transmitter which is conveniently stored in an automobile, brief case, or purse when not being used.

It is another object of the invention to provide a security system which includes an emergency alarm which is easily triggered by the resident in response to an attack as the resident travels from an automobile to the entrance of the home.

It is another object of the invention to provide a security system which automatically reports the location of the resident to legal authorities upon activation of the emergency alarm.

It is another object of the invention to provide a security system which automatically triggers operation of one or more preselected electrical accessories associated with the home.

It is another object of the invention to provide a security system which automatically triggers operation of one or more preselected electrical accessories in a fixed, predetermined sequence.

It is another object of the invention to provide a security system which automatically triggers operation of one or more preselected electrical accessories in a random sequence to thereby reduce the predictability of the resident's actions after entering the home.

It is another object of the invention to provide a security system which will not automatically trigger operation of one or more preselected electrical accessories if one or more of a plurality of security sensors has previously detected an intruder.

These and other objects of the present invention are achieved in the preferred embodiments disclosed below by providing a security system for monitoring security in the vicinity of a location perimeter. The security system includes detection means positioned in a detecting relation to the location perimeter for detecting a condition indicating a potential violation of security within the perimeter. The detection means has a normal, negative state indicative of no violation of security and a positive state indicative of a potential violation of security. Storage means operatively communicates with the detection means for storing information indicating whether the detection means is in the positive or negative state. Signal receiving means operatively communicates with the storage means. Signal transmitting means is activated from outside the location perimeter, and transmits a control signal to the signal receiving means.

Indicator means operatively communicates with the storage means for indicating to a position outside the location perimeter the current positive or negative state of the detection means. Indicator activation means operatively communicates with the indicator means, and responds to the signal received by the signal receiving means from the signal transmitting means. For the negative state of the detection means, the indicator activation means communicates to the position outside the location perimeter the negative state of the detection means indicating no violation of security. For the positive state of the detection means, the indicator activation means communicates to the position outside the location perimeter the positive state of the detection means indicating a potential violation of security.

According to one preferred embodiment of the invention, the detection means includes a plurality of security sensors spaced-apart within the vicinity of the location perimeter.

According to another preferred embodiment of the invention, the signal transmitting means is a hand-held, radio transmitter having at least one push-button control for being manually actuated to transmit the control signal to the signal receiving means.

According to yet another preferred embodiment of the invention, the signal receiving means is a radio receiver for receiving the control signal transmitted by the radio transmitter.

According to yet another preferred embodiment of the invention, the indicator means is an electrical warning device located in the vicinity of the location perimeter. The warning device indicates to a position outside the location perimeter the current positive or negative state of the detection means. For the positive state of the detection means, the indicator activation means directs an energizing voltage to the warning device for activating the warning device, and indicating a potential violation of security.

According to yet another preferred embodiment of the invention, the warning device is an electric light.

According to yet another preferred embodiment of the invention, manual reset means operatively communicates with the indicator activation means for deactivating the warning device.

According to yet another preferred embodiment of the invention, emergency alarm activation means operatively communicates with the signal transmission means for directing an energizing voltage to an emergency alarm located in the vicinity of the location perimeter.

According to yet another preferred embodiment of the invention, timer means operatively communicates with the signal receiving means. The timer means cooperates with the emergency alarm activation means for providing a preset activation time period within which the emergency alarm is activated.

According to yet another preferred embodiment of the invention, manual reset means operatively communicates with the emergency alarm activation means for deactivating the emergency alarm.

According to yet another preferred embodiment of the invention, accessory activation means automatically controls a plurality of electrical accessories associated with the location perimeter. The accessory activation means operatively communicates with the indicator means, and responds to the signal received by the signal receiving means from the signal transmitting means. For the negative state of the detection means, the accessory activation means directs an energizing voltage to one or more of the plurality of electrical accessories to activate the electrical accessory. For the positive state of the detection means, the accessory activation means is inoperative.

According to yet another preferred embodiment of the invention, the accessory activation means automatically controls operation of the electrical accessories in a fixed sequence.

According to yet another preferred embodiment of the invention, the accessory activation means automatically controls operation of the electrical accessories in a random sequence.

An embodiment of the method according to the invention includes the steps of providing detection means for detecting a condition indicating a potential violation of security within the perimeter. The detection means has a normal, negative state indicative of no violation of security and a positive state indicative of a potential violation of security. A second step includes the step of storing information indicating whether the detection means is in the positive or negative state. A third step includes the step of interrogating the detection means. A fourth step includes the step of indicating to a position outside the location perimeter the current positive or negative state of the detection means.

According to another preferred embodiment of the invention, the interrogating step includes the step of activating signal transmitting means from outside the location perimeter for transmitting a control signal to signal receiving means.

According to another preferred embodiment of the invention, the method includes the step of providing emergency alarm activation means for directing an energizing voltage to an emergency alarm located in the vicinity of the location perimeter.

According to another preferred embodiment of the invention, the method includes the step of providing a preset activation time period within which the emergency alarm is activated.

According to another preferred embodiment of the invention, the method includes the step of automatically controlling a plurality of electrical accessories associated with the location perimeter. For the negative state of the detection means, an energizing voltage is directed to one or more of the plurality of electrical accessories to activate the electrical accessory. For the positive state of the detection means, the electrical accessories are inactive.

According to another preferred embodiment of the invention, the accessory controlling step includes the step of automatically controlling operation of the electrical accessories in a fixed sequence.

According to another preferred embodiment of the invention, the accessory controlling step includes the step of automatically controlling operation of the electrical accessories in a random sequence.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
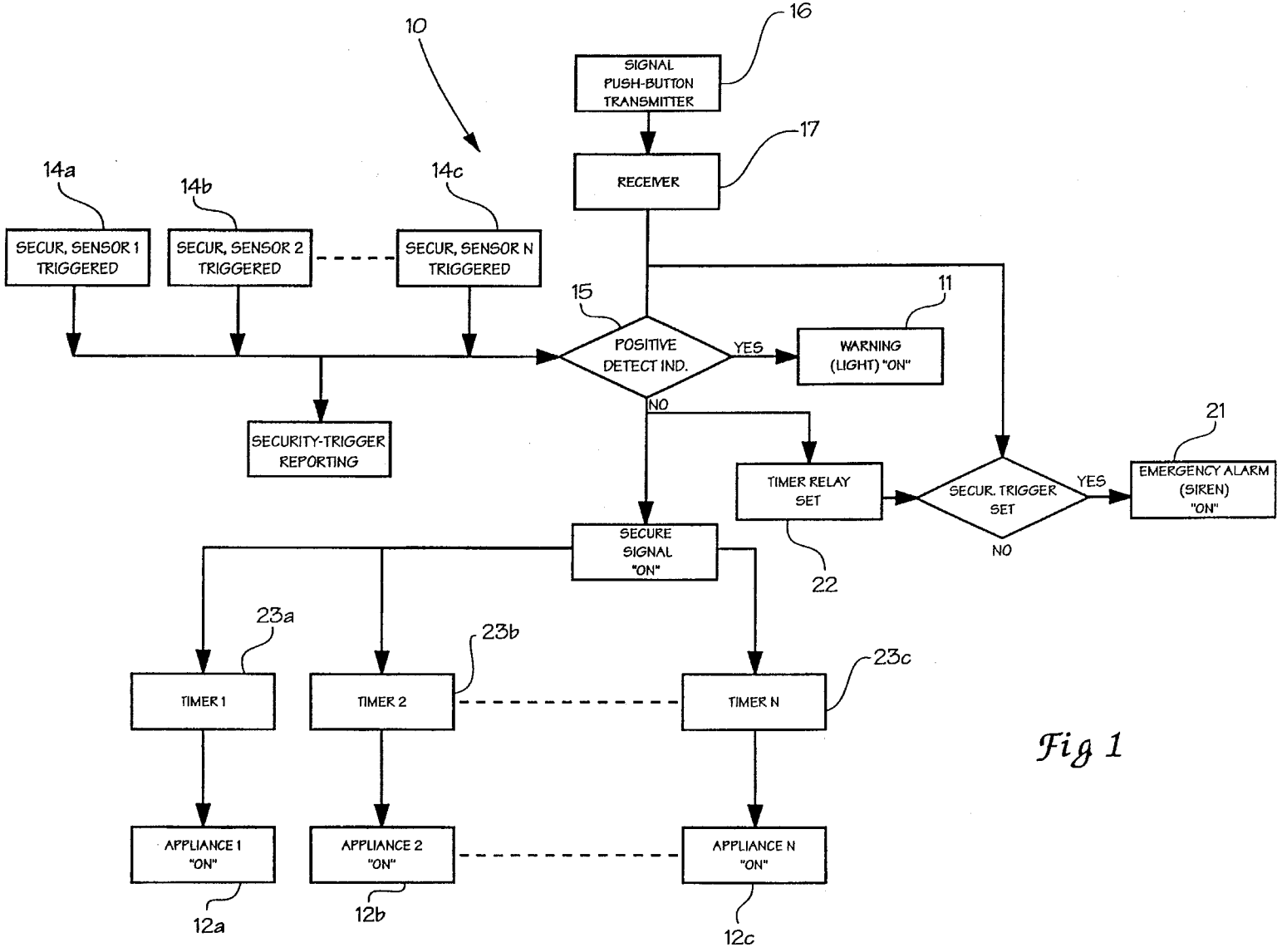
FIG. 1 is a flow diagram illustrating operation of the security system according to one preferred embodiment of the invention.

Referring now specifically to the drawings, a security system according to the present invention is illustrated in the flow diagram of FIG. 1, and indicated generally at broad reference numeral 10. The security system 10 is applicable to a residence for automatically operating an electrical warning device 11, and for controlling one or more preselected electrical accessories 12A, 12B, 12C associated with the home. In alternative applications, the security system 10 may be used for business premises, apartment buildings, storage warehouses, or open areas of land, such undeveloped residential or commercial lots.

The security system 10 includes several security sensors 14A, 14B, 14C spaced-apart within the vicinity of the home. The security sensors 14A, 14B, 14C operate to detect the presence of an intruder. The security sensors 14A, 14B, 14C have a normal, negative state indicative of no violation of security, and a positive state indicative of a potential violation of security. A detection indicator 15 stores information indicating whether one or more of the security sensors 14A, 14B, 14C are in the positive or negative state. The detection indicator 15 is subsequently interrogated by the security system 10, as described below. The security sensors 14A, 14B, 14C may be any suitable device known in the art, such as motion detectors, infrared sensor beams, photo cells, and the like, for detecting the movement or presence of an intruder.

As illustrated in FIG. 1, the security system 10 includes a signal transmitter 16 and receiver 17. Preferably, the transmitter 16 is a hand-held radio transmitter which is conveniently stored in the resident's car, purse, or brief case when not being used. The transmitter 16 includes a manual push-button control 16A (See FIG. 3) which, when depressed, will cause the transmitter 16 to emit an amplitude modulated control signal.

The receiver 17 is preferably a radio receiver which receives the control signal, and initiates interrogation of the security sensors 14A, 14B, 14C. If any one of the security sensors 14A, 14B, 14C has previously detected an intruder, the detection indicator 15 will cause activation of the warning device 11 for alerting the resident of the potentially dangerous condition. The warning device 11 may be any predetermined electrical device located within or near the home, such as an outdoor post lamp, kitchen light, automatic garage door, or door bell. Alternatively, the warning device 11 may be a predetermined sequence of operation of electrical devices, or any other electrically actuated occurrence known only to the resident. In addition, the detection indicator 15 may include a microprocessor for storing information regarding the state of the security sensors 14A, 14B, 14C, and for causing activation of the warning device 11 when one or more of the security sensors 14A, 14B, 14C are in the positive state.

The warning device 11 is turned on, if at all, within seconds after the resident depresses the manual push-button control 16A of the transmitter 16. A positive state of the security sensors 14A, 14B, 14C may have been effected hours or even days prior to the resident's home arrival.

Regardless of whether the warning device 11 has been triggered, the resident may choose to leave the relative safety of an automobile or friends and enter the home. Preferably, if the warning device 11 has been triggered, the security system 10 will not automatically operate the electrical accessories 12A, 12B, 12C of the home. Instead, the resident must manually control each of the accessories 12A, 12B, 12C in a conventional manner.

In an alternative embodiment of the security system 10, a selected one or more of the electrical accessories 12A, 12B, 12C, such as outdoor flood lights, may automatically operate if the warning device 11 has been activated. A control unit located inside the home includes an electric switch 26 (See FIG. 3) for automatically turning off the warning device 11, and resetting the security system 10.

Preferably, the security system 10 further includes a timer relay 22 and emergency alarm 21. The emergency alarm 21 may be triggered by the resident while traveling from the automobile to the entrance of the home. The emergency alarm 21 is easily activated by the resident with a second press of the push-bottom control 16A of the transmitter 16. The transmitter 16 emits a second control signal which triggers operation of the emergency alarm 21. The emergency alarm 21 may be a siren, an automatic 911 telephone call, or other suitable alarm means. The emergency alarm 21 is preferably operable regardless of whether the warning device 11 has been triggered.

The timer relay 22 is activated after receipt of the first control signal from the transmitter 16, and remains activated for a preset time period; for example, the estimated time required for the resident to walk from the automobile to the entrance of the home. To trigger the emergency alarm 21, the resident must depress the push-button control 16A of the transmitter 16 a second time while the timer relay 22 is still active. If the timer relay 22 is not active, the emergency alarm 21 will not turn on. The control unit inside the home preferably includes a second electric switch 27 (See FIG. 3) for automatically turning off the emergency alarm 21.

If the warning device 11 has not been triggered, the security system 10 will automatically control operation of one or more of the electrical accessories 12A, 12B, 12C associated with the home. The electrical accessories 12A, 12B, 12C may be, for example, an automatic door opener, door bell, floodlights, kitchen appliances, garage doors, interior lights, outdoor lights, and the like.

According to one embodiment, the security system 10 includes preset delay-on relays 23A, 23B, 23C corresponding to respective electrical accessories 12A, 12B, 12C for automatically turning on the accessories 12A, 12B, 12C according to a fixed, predetermined sequence. For example, the relays 23A, 23B, 23C may trigger operation of the accessory 12A, 12B, 12C according to one particular sequence each time the resident arrives home and depresses the push-button control 16A of the transmitter 16. For example, after arriving home at the end of each day, the resident may desire the front door to automatically open 10 seconds after depressing the push-button control 16A, the kitchen light to automatically turn on after 15 seconds, and the television to automatically turn on after 30 seconds.

Figure 2:
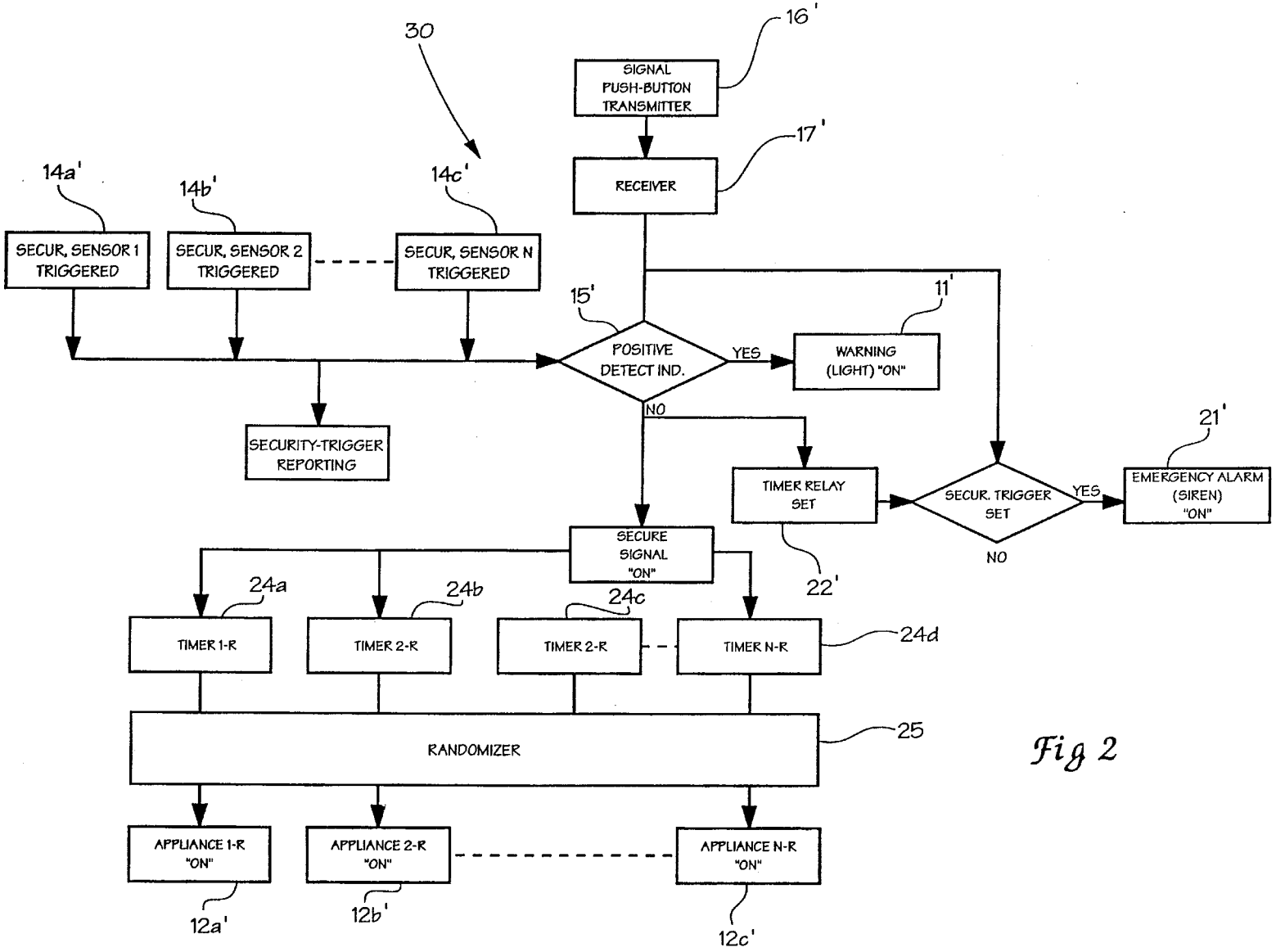
FIG. 2 is a flow diagram illustrating operation of security system according to a second preferred embodiment of the invention.

A second embodiment of the security system 30 is illustrated in the flow diagram of FIG. 2. Like elements previously described with reference to the security system 10 of FIG. 1 are indicated in prime notation The transmitter 16' receiver 17' warning device 11' and emergency alarm 21' function in an identical manner to that described above with reference to the security system 10.

The security system 30 includes several delay-on relays 24A, 24B, 24C, and 24D, and a randomizer 25. The relays 24A–24D and randomizer 25 cooperate to automatically turn on the accessories 12A', 12B', 12C' in a random sequence each time the resident arrives home and sends the control signal of the transmitter 16'. For example, the accessories 12A' 12B' and 12C' will turn on according to one sequence one day, and according to a different sequence the next day. This reduces the predictability of the resident's actions after entering the home, and may deter a premeditated attack by an intruder.

Electrical Diagram of the Security System 10

Figure 3:
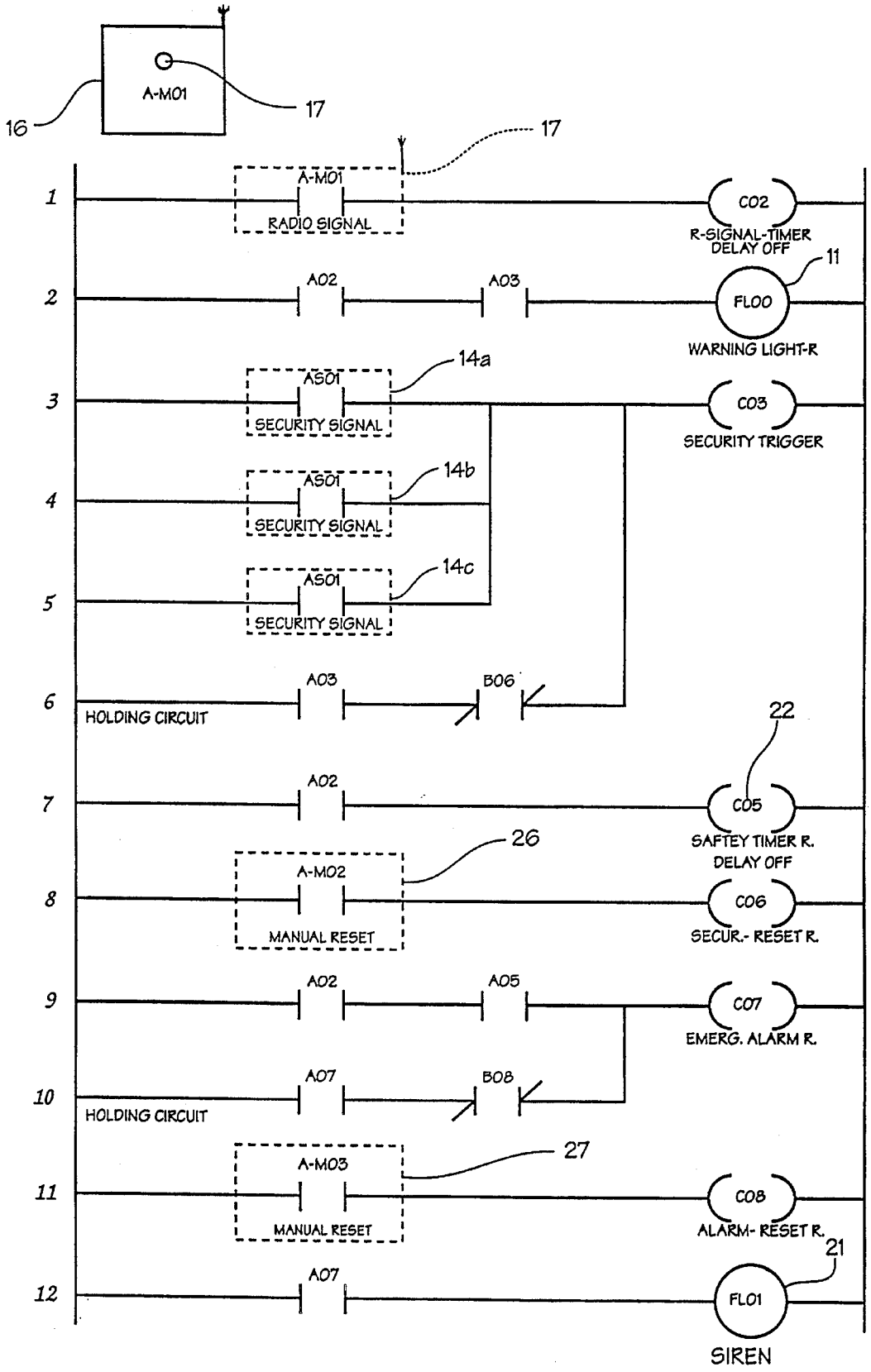
FIG. 3 is a electrical diagram illustrating operation of the warning light and emergency alarm of the security system according to the embodiment of FIG. 1.
Figure 4:
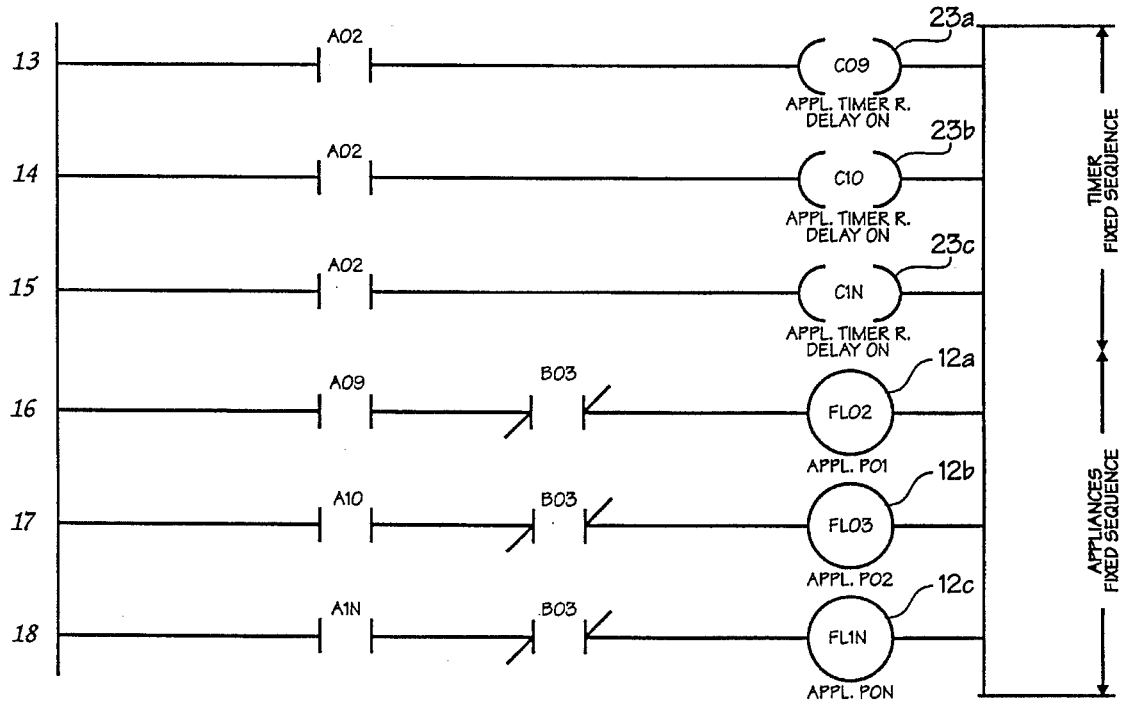
FIG. 4 is a electrical diagram illustrating automatic operation of a plurality of electrical accessories associated with the home in a fixed sequence.

Referring now to FIGS. 3 and 4, an electrical diagram of the security system 10 (See FIG. 1) according to one preferred embodiment is illustrated. As shown in lines 1–6 of FIG. 3, the resident initiates interrogation of the security sensors 14A, 14B, 14C by pressing the push-button control 16A on the remote transmitter 16. The control signal is received by the receiver 17, and contact A-M01 closes. Relay C02 is activated, and closes contact A02. If any one of the security sensors 14A, 14B, 14C has been previously triggered, the detection indicator 15 relays a positive state, and one or more of corresponding security sensor contacts AS01-AS0N is closed. In this event, a warning device relay C03 will activate and close contact A03. This will turn on the warning device FL00 (11).

As shown in line 8 of FIG. 3, the resident can turn off the warning device 11 by actuating the first electric switch 26 of the control unit located inside the home. This closes contact A-M02 and activates relay C06. Relay C06 opens a normally closed contact B06, and thus turns off the warning device FL00 (11).

As described above, contact A02 closes upon receiving the control signal. This activates delay-off timer relay C05 (22) for a preset length of time, such as the estimated time required for the resident to exit an automobile and enter the home. Timer relay C05 (22) closes contact A05, as shown in line 9 of FIG. 3.

To trigger the emergency alarm 21, the resident must re-close contact A02 by pressing the push-button control 16A a second time while the timer relay C05 (22) is still active. This will activate an emergency alarm relay C07. Relay C07 closes contact A07 to trigger operation of the emergency alarm FL01 (21). The emergency alarm 21 will remain activated until normally closed contact B08 is opened. The emergency alarm 21 is turned off by actuating the second electric switch 27 of the control unit. This closes reset contact A-M03. Contact A-M03 activates relay C08. Activated relay C08 opens the normally closed contact B08, which deactivates the emergency alarm relay C07. Contact A07 opens, and the emergency alarm FL01 (21) turns off.

FIG. 4 illustrates operation of the electrical home accessories 12A, 12B, 12C in a fixed sequence after the resident has depressed the push-button control 16A of the transmitter 16. Contact A02 closes, as previously described, and activates delay-on relays C09-C1N (23A, 23B, 23C). Relays C09-C1N (23A, 23B, 23C) correspond to the electrical accessories FL02-FL1N (12A, 12B, 12C). C1N and FL1N refer to the last any given number of delay-on relays 23A, 23B, 23C, and accessories 12A, 12B, 12C.

When delay-on relay C09 (23A) activates after a preset time delay, contact A09 closes and triggers operation of accessory FL02 (12A). Contacts A10-A1N close, respectively, upon activation of delay-on relays C10-C1N (23B, 23C), thus triggering operation of accessories FL03-FL1N (12B, 12C). Contact B03 remains closed unless previously opened by the warning device relay C03. Thus, if relay C03 was activated in response to one of the security sensors 14A, 14B, 14C, the normally closed contact B03 will open. If contact B03 is opened, the electrical accessories FL02-FL1N (12A, 12B, 12C) will not automatically turn on.

Electrical Diagram of the Security System 30

Figure 5:
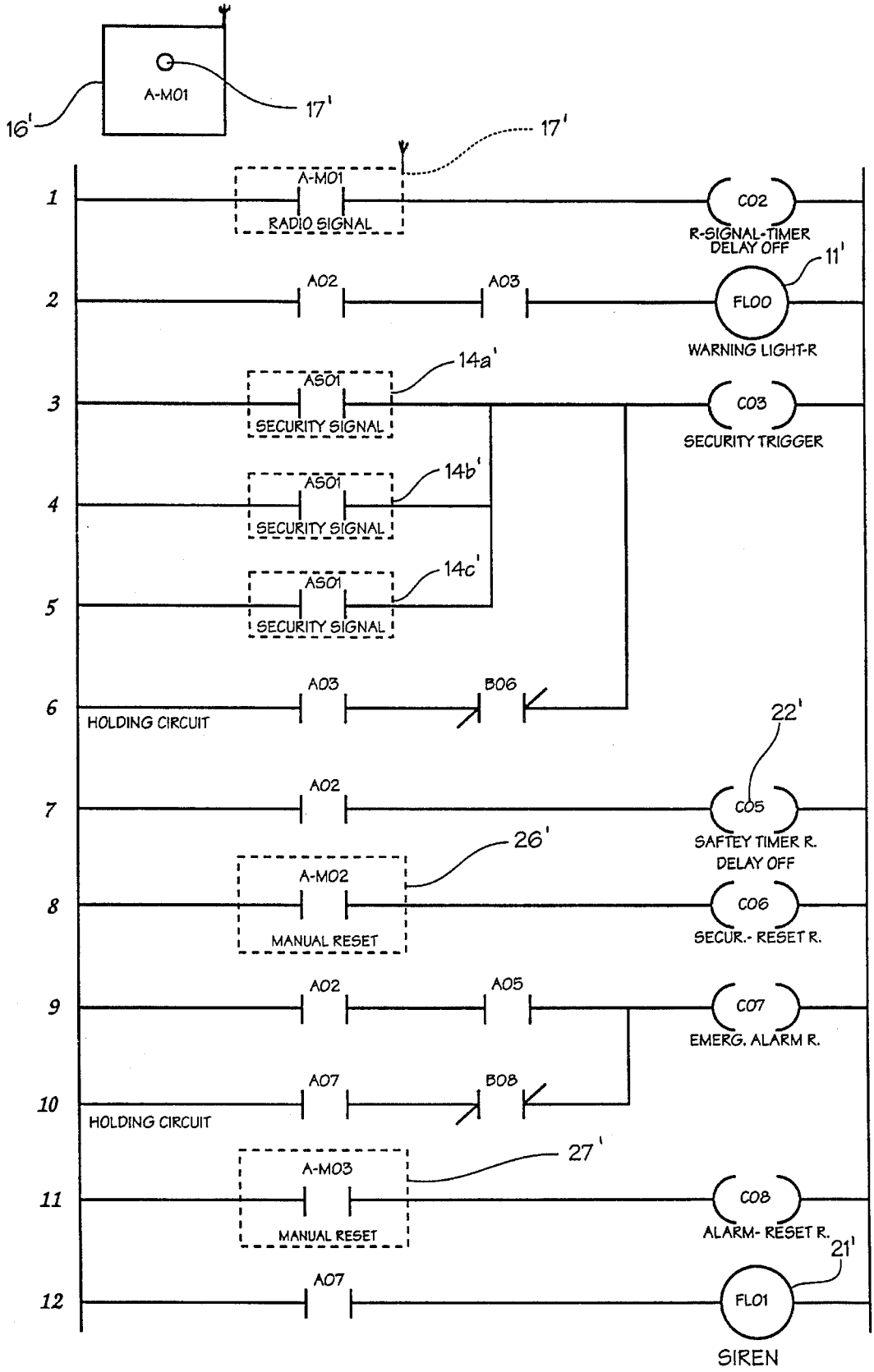
FIG. 5 is a electrical diagram illustrating operation of the warning light and emergency alarm of the security system according to the embodiment of FIG. 2.
Figure 6:
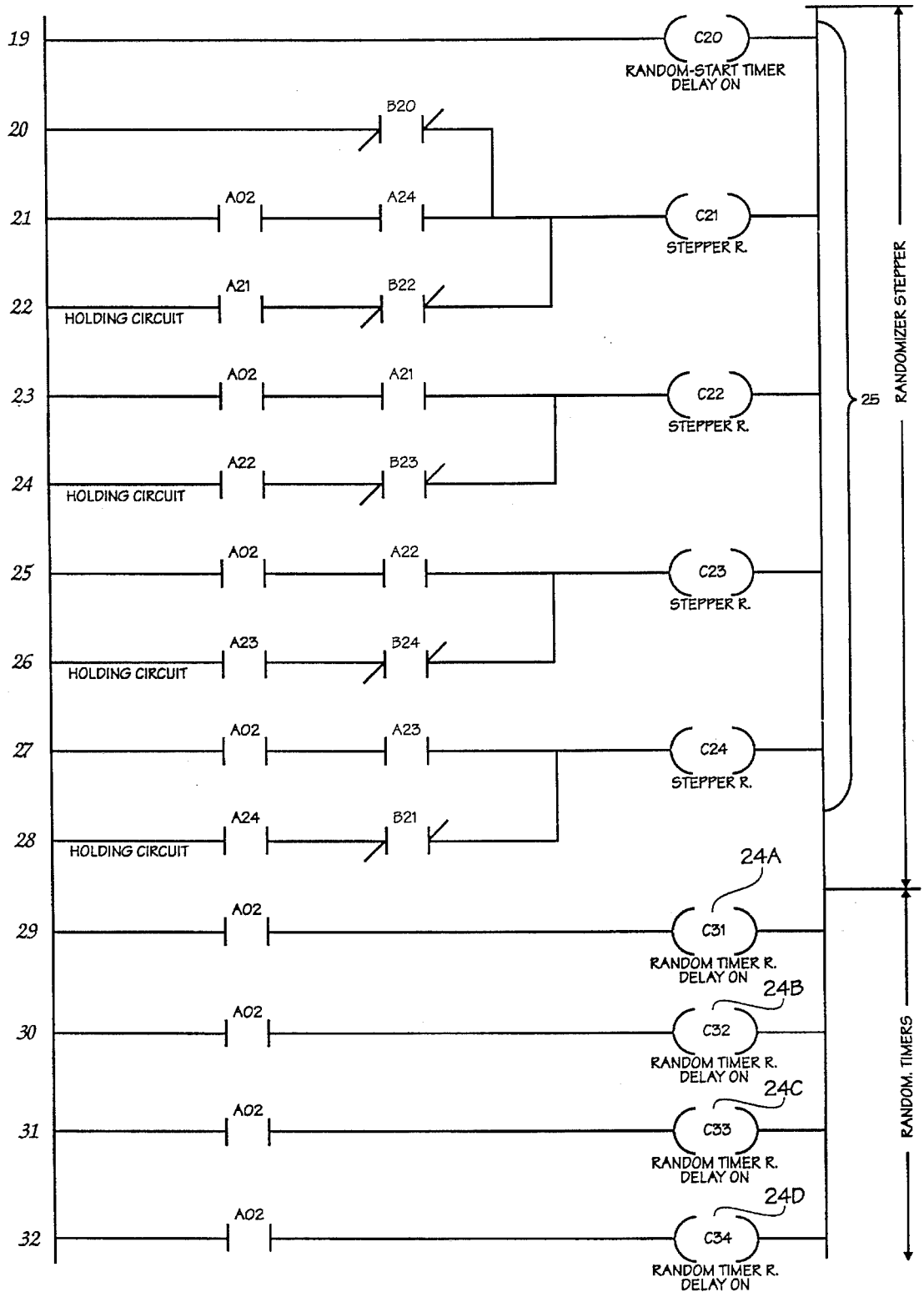
FIG. 6 is a electrical diagram illustrating operation of the randomizer and time delay-on relays of the security system according to the embodiment of FIG. 2.
Figure 7:
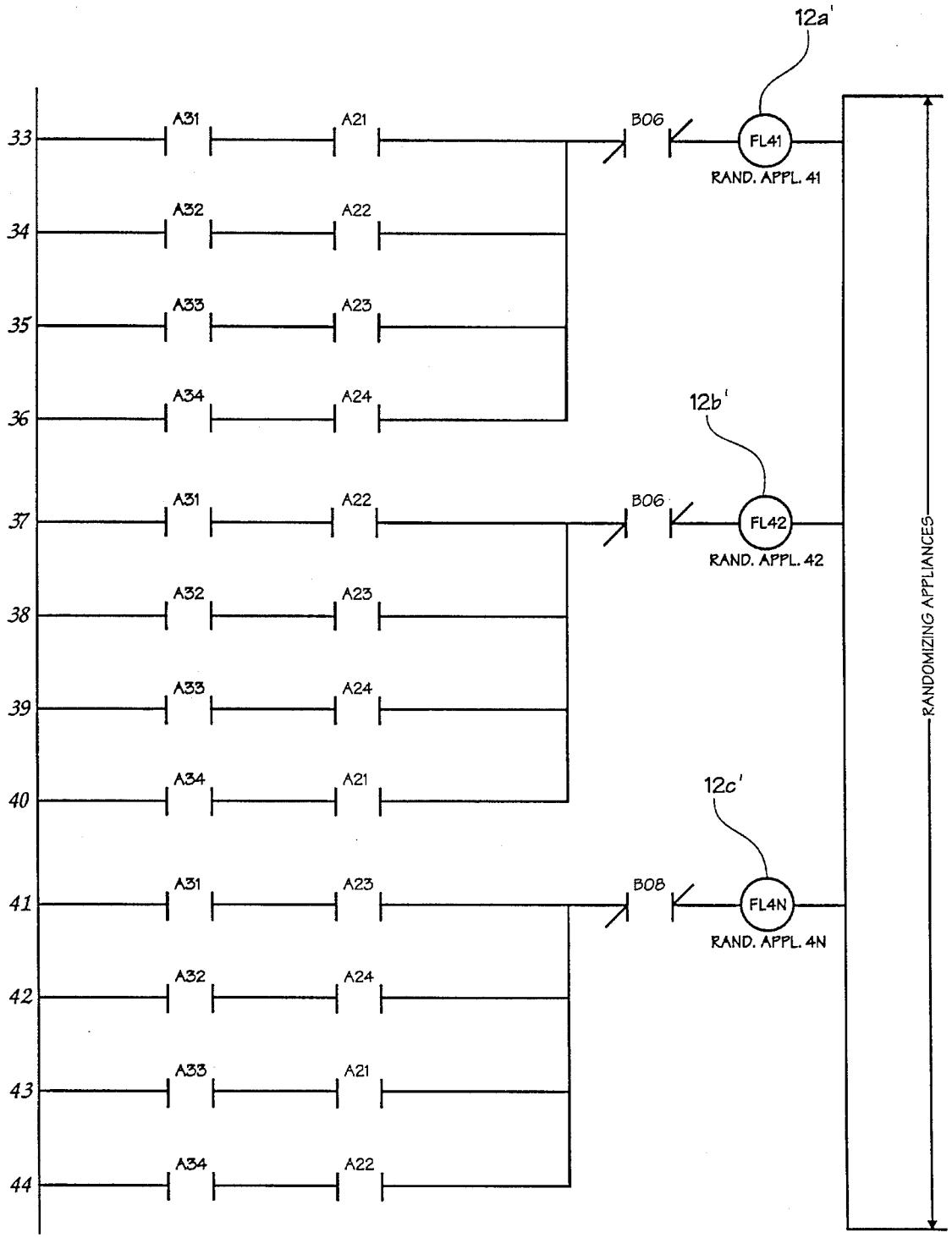
FIG. 7 is a electrical diagram illustrating the automatic operation of a plurality of electrical accessories associated with the home in a random sequence.

An electrical diagram of the security system 30 (See FIG. 2) is illustrated in FIGS. 5–7. Like elements previously described with reference to the security system 10 of FIGS. 1, 3, and 4 are indicated in prime notation. As shown in FIG. 5, the transmitter 16', receiver 17', warning device 11', and emergency alarm 21' function in an identical manner to that described above with reference to the security system 10.

FIGS. 6 and 7 illustrate operation of the delay-on timers 24A–24D and randomizer 25 for triggering operation of the electrical accessories 12A', 12B', 12C' in a random sequence Operation of the electrical accessories 12A', 12B', 12C' occurs in a different sequence each time the resident arrives home and depresses the push-button control 16A' of the transmitter 16'; for example, at the end of each day.

For the first day, the control signal emitted by the transmitter 16' will cause activation of a stepper relay C21. As indicated in FIG. 6, closed contact B20 activates relay C21, while relays C22, C23, and C24 remain in-active. Relay C21 closes contact A21, and cooperates with time-delay-on relays C31–C34 (24A24D), as described below, to trigger operation of the accessories 12A', 12B', 12C' according to a first particular sequence.

For the second day, the control signal emitted by the transmitter 16' will cause activation of a stepper relay C22. Previously activated relay C21 closes contact A21 which activates the relay C22. Relay C22 closes contact A22, and cooperates with time-delay-on relays C31–C34 (24A–24D) to trigger operation of the accessories 12A', 12B', 12C' in a sequence different from that of the previous day. Relay C22 opens closed contact B22 which thereby deactivates relay C21.

For the third day, the control signal emitted by the transmitter 16' will cause activation of a stepper relay C23. Previously activated relay C22 closes contact A22 which activates relay C23. Relay C23 closes contact A23, and cooperates with time-delay-on relays C31–C34 (24A–24D) to trigger operation of the accessories 12A', 12B', 12C' in a sequence different from that of the previous day. Relay C23 opens closed contact B23 which thereby deactivates relay C22.

For the fourth day, the control signal emitted by the transmitter 16' will cause activation of a stepper relay C24. Previously activated relay C23 closes contact A23 which activates relay C24. Relay C24 closes contact A24, and cooperates with time-delay-on relays C31–C34 (24A–24D) to trigger operation of the accessories 12A', 12B', 12C' in a sequence different from that of the previous day. Relay C24 opens closed contact B24 which thereby deactivates relay C23.

For the fifth day, the control signal emitted by the transmitter 16' will cause re-activation of the stepper relay C21. Previously activated relay C24 closes contact A24 which activates relay C21. Relay C21 closes contact A21, and cooperates with time-delay-on relays C31–C34 (24A–24D) to trigger operation of the accessories 12A', 12B', 12C' in a sequence different from that of the previous day. Relay C21 opens closed contact B21 which thereby deactivates relay C24.

For the sixth day and beyond, the relays C21–C24 are activated in steps, as described above, for continuously randomizing operation of the electrical accessories 12A', 12B', 12C'. If the security system 30 loses power to the electrical circuit and power is subsequently re-applied, a time-delay-on relay C20 is triggered and the randomizing cycle is re-started. Normally closed contact B20 will activate stepper relay C21. Relay C20 will become active after a preset time period to open contact B20, and deactivate relay C21.

Referring now to lines 29–32 of FIG. 6, random delay-on relays C31, C32, C33, and C34 (24A–24D) were triggered in response to the closing of contact A02 after transmission of the control signal from the transmitter 16'. Contacts C31–C34 (24A–24D) will become active according to a preset time interval; for example, in 5 second increments.

The operation of accessories FL41-FL4N (12A', 12B', 12C') is randomized as described below. The accessory FL4N indicates the last of any given number of accessories 12A', 12B', 12C'.

Contacts A31–A34 (See FIG. 7) will close dependant upon the activation of corresponding delay-on relays C31–C34 (24A–24D). Contacts A21–A24 will close in steps, as described above. Thus, when a set of complementary contacts A31-A34 and A21-A24 are closed, operation of the indicated accessory FL41-FL4N (12A', 12B', 12C') will be triggered.

For example, for the first day in which the resident arrives home, contact A21 closes. Thus, when delay-on relay C31 activates and closes contact A31 after a preset time period, the accessory FL41 (12A') will turn on. When delay-on relay C34 activates and closes contact A34, the accessory FL42 (12B') will turn on. When delay-on relay C33 activates and closes contact A33, the accessory FL4N (12C') will turn on.

Other combinations for operating each of the accessories 12A', 12B', 12C' on successive days are indicated in FIG. 5 In addition, it is understood that any suitable number of stepper relays (25) and time-delay-on relays (24A–24D) may be used for adequately randomizing operation of the accessories 12A', 12B', 12C' .

The accessories FL41-FL4N (12A', 12B', 12C') may be turned off by the resident by actuating the first electric switch 26' of the control unit. The electric switch 26' closes contact A-M02 and activates relay C06. Relay C06 opens the normally closed contact B06, and thus deactivates each of the accessories FL41-FL4N (12A', 12B', 12C')

In alternative embodiments of the security system 10, 30, a microprocessor is utilized for activating the circuitry of the warning device 11, and electrical accessories 12A, 12B, 12C of the home. A random number generator may be used for triggering random operation of the electrical accessories 12A, 12B, 12C. The security system 10, 30 may also include a battery back-up in case of power loss.

In addition, the security system 10, 30 may utilize a cellular telephone to initiate transmission of the control signal. According to this embodiment, the user telephones the home from a remote location, and dials-in a coded number after an answering machine receives the call. The telephone communicates with a microprocessor including a modem and interface card, or a special design electronic module, which triggers emission of the control signal. The control signal initiates interrogation of the security sensors, as previously described.

The terms "relay" and "contact" as used herein refer, respectively, to a standard electric coil and electric contact well known and understood in the art.

A security system, and method for monitoring security in the vicinity of a location perimeter is described above. Various details of the invention may be changed without departing from its scope. Furthermore, the foregoing description of the preferred embodiment of the invention is provided for the purpose of illustration only and not for the purpose of limitation—the invention being defined by the claims.

We claim:

1. A personal security system for periodic interrogation by an authorized user of the system for monitoring security in the vicinity of a location perimeter to permit the system user to determine a potential violation of security before entering the location perimeter, said personal security system comprising:

(a) detection means positioned in a detecting relation to the location perimeter for detecting a condition indicating a potential violation of security in the vicinity of the perimeter, said detection means having a normal, negative state indicative of no violation of security and a positive state indicative of a potential violation of security;

(b) storage means electrically connected to said detection means for storing information indicating whether the detection means is in the positive or negative state;

(c) signal receiving means electrically connected to said storage means;

(d) signal transmitting means for being operated by the system user, and activated from outside the location perimeter for transmitting a system interrogation control signal to said signal receiving means for interrogating the security system to determine the state of said detection means;

(e) indicator means electrically connected to said storage means for indicating to a position outside the location perimeter and to the system user the current positive or negative state of the detection means; and (f) indicator activation means electrically connected to said indicator means and responsive to the system interrogation control signal received by said signal receiving means from said signal transmitting means, such that:

(1) for the negative state of said detection means, said indicator activation means communicates to the position outside the location perimeter and to the system user the negative state of the detection means indicating no violation of security; and (2) for the positive state of said detection means, said indicator activation means communicates to the position outside the location perimeter and to the system user the positive state of the detection means indicating a potential violation of security.

2. A security system according to claim 1, wherein said detection means comprises a plurality of security sensors spaced-apart within the vicinity of the location perimeter.

3. A security system according to claim 1, wherein said signal transmitting means comprises a radio transmitter having at least one push-button control for being manually actuated to transmit the control signal to said signal receiving means.

4. A security system according to claim 3, wherein said signal receiving means comprises a radio receiver for receiving the control signal transmitted by said radio transmitter.

5. A security system according to claim 1, wherein said indicator means comprises an electrical warning device located in the vicinity of the location perimeter, and indicating to a position outside the location perimeter the current positive or negative state of the detection means, such that for the positive state of said detection means, said indicator activation means directs an energizing voltage to said warning device for activating said warning device and indicating a potential violation of security.

6. A security system according to claim 5, wherein said warning device comprises an electric light.

7. A security system according to claim 5, and including manual reset means electrically connected to said indicator activation means for deactivating said warning device.

8. A security system according to claim 1, and including emergency alarm activation means electrically connected to said signal transmitting means for directing an energizing voltage to an emergency alarm located in the vicinity of the location perimeter.

9. A security system according to claim 8, wherein said signal transmitting means comprises a radio transmitter having at least one push-button control for transmitting the control signal to said signal receiving means, and for directing the energizing voltage to the emergency alarm located in the vicinity of the location perimeter to thereby activate the emergency alarm.

10. A security system according to claim 9, and including timer means electrically connected to said signal receiving means and cooperating with said emergency alarm activation means for providing a preset activation time period within which the emergency alarm is activated.

11. A security system according to claim 10, and including manual reset means electrically connected to said emergency alarm activation means for deactivating the emergency alarm.

12. A security system according to claim 1, and including accessory activation means for automatically controlling a plurality of electrical accessories associated with the location perimeter, said accessory activation means electrically connected to said indicator means and responsive to the system interrogation control signal received by said signal receiving means from said signal transmitting means, such that:

(1) for the negative state of said detection means, said accessory activation means directs an energizing voltage to one or more of the plurality of electrical accessories to activate the electrical accessory; and (2) and for the positive state of said detection means, said accessory activation means is inoperative.

13. A security system according to claim 12, wherein said accessory activation means automatically controls operation of the electrical accessories in a fixed sequence.

14. A security system according to claim 12, wherein said accessory activation means automatically controls operation of the electrical accessories in a random sequence.

15. A method for monitoring security in the vicinity of a location perimeter to permit a system user to determine a potential violation of security before entering the location perimeter, the method comprising the steps of:

(a) providing detection means for detecting a condition indicating a potential violation of security in the vicinity of the perimeter, said detection means having a normal, negative state indicative of no violation of security and a positive state indicative of a potential violation of security;

(b) providing storage means for storing information indicating whether the detection means is in the positive or negative state;

(c) providing signal receiving means electrically connected to said storage means;

(d) activating signal transmitting means operable by the system user from outside the location perimeter for transmitting a system interrogation control signal to said signal receiving means for interrogating the security system to determine the state of said detection means;

(e) providing indicator means electrically connected to said storage means for indicating to the system user the current positive or negative state of the detection means; and (f) activating said indicator means in response to the system interrogation control signal received by said signal receiving means from said signal transmitting means, such that:

(1) for the negative state of said detection means, said indicator activation means communicates to the system user the negative state of the detection means indicating no violation of security; and (2) for the positive state of said detection means, said indicator activation means communicates to the system user the positive state of the detection means indicating a potential violation of security; and (g) providing emergency alarm activation means for directing an energizing voltage to an emergency alarm located in the vicinity of the location perimeter.

16. A method according to claim 15, and including the step of providing a preset activation time period within which the emergency alarm is activated.

17. A method according to claim 15, and including the step of automatically controlling a plurality of electrical accessories associated with the location perimeter, such that:

(1) for the negative state of said detection means, an energizing voltage is directed to one or more of the plurality of electrical accessories to activate the electrical accessory; and (2) and for the positive state of said detection means, the electrical accessories are inactive.

18. A method according to claim 17, wherein said accessory controlling step comprises the step of automatically controlling operation of the electrical accessories in a fixed sequence.

19. A method according to claim 17, wherein said accessory controlling step comprises the step of automatically controlling operation of the electrical accessories in a random sequence.

* * * * *